US010026522B1

(12) United States Patent
Gebs

(10) Patent No.: US 10,026,522 B1
(45) Date of Patent: Jul. 17, 2018

(54) FLAME RETARDANT INSULATION MATERIAL FOR USE IN A PLENUM CABLE

(71) Applicant: Superior Essex International LP, Atlanta, GA (US)

(72) Inventor: Bernhart A. Gebs, Powder Springs, GA (US)

(73) Assignee: Superior Essex International LP, Atlanta, GA (US)

( * ) Notice: Subject to any disclaimer, the term of this patent is extended or adjusted under 35 U.S.C. 154(b) by 364 days.

(21) Appl. No.: 14/463,222

(22) Filed: Aug. 19, 2014

(51) Int. Cl.
*H01B 3/44* (2006.01)
*H01B 3/42* (2006.01)
*H01B 3/30* (2006.01)

(52) U.S. Cl.
CPC ..... *H01B 3/448* (2013.01); *H01B 3/305* (2013.01); *H01B 3/421* (2013.01); *H01B 3/441* (2013.01); *H01B 3/445* (2013.01)

(58) Field of Classification Search
CPC ..... H01B 2/201; H01B 3/301
USPC ..... 174/110 R
See application file for complete search history.

(56) References Cited

U.S. PATENT DOCUMENTS 6,147,309 A 11/2000 Mottine et al.
6,646,205 B2 * 11/2003 Hase et al. ..... 174/110 R
6,894,227 B2 * 5/2005 Kanamori ..... C08F 255/02 174/110 R
7,340,134 B1 3/2008 Hudson et al.
8,470,919 B2 6/2013 Robinson
8,525,028 B2 9/2013 Cree et al.
8,598,268 B2 12/2013 Aitken et al.
8,618,207 B2 12/2013 Sultan
8,750,661 B2 6/2014 Bringuier et al.
8,765,035 B2 7/2014 Grasselli et al.
9,115,254 B2 * 8/2015 Sasamura ..... B29C 44/0461 174/110 F
2006/0121288 A1 * 6/2006 Mochizuki ..... C08L 27/18 428/421
2010/0147555 A1 * 6/2010 Laura, Jr. ..... D04H 3/011 174/137 R
2010/0151760 A1 * 6/2010 Laura, Jr. ..... B32B 27/12 442/364
2010/0210745 A1 * 8/2010 McDaniel et al. ..... 521/55
2013/0051745 A1 2/2013 Weimann
2013/0052897 A1 * 2/2013 Rogers et al. ..... 442/58
2014/0069686 A1 * 3/2014 Abe ..... H01B 7/02 174/110 SR
2014/0249286 A1 * 9/2014 Arriola et al. ..... 526/348.2

* cited by examiner

*Primary Examiner* — Timothy Thompson
*Assistant Examiner* — Stanley Tso

(57) ABSTRACT

An insulation material for use in a plenum-rated communications cable, as well as components formed from the insulation material are described. The insulation material may include a base polymeric material having a first melting point, the first melting point lower than a temperature at which the insulation material is extruded to form a cable component. The insulation material may also include a polymeric filler material blended throughout the base polymeric material, the filler material having a second melting point greater than the temperature at which the insulation material is extruded.

20 Claims, 7 Drawing Sheets

FLAME RETARDANT INSULATION MATERIAL FOR USE IN A PLENUM CABLE

TECHNICAL FIELD

Embodiments of the disclosure relate generally to components that may be incorporated into plenum cables and, more particularly, to flame retardant insulation materials and/or components formed from the insulation materials that may be incorporated into plenum cables.

BACKGROUND

A wide variety of different types of cables are utilized to transmit signals. For example, communication cables, such as twisted pair and optical fiber cables, are utilized to transmit data signals. Plenum cables include cables designed for use in horizontal or plenum spaces within a facility, such as spaces utilized for heating and air conditioning systems. Applicable cable and fire standards, such as the National Fire Protection Act ("NFPA") standard 90A, require plenum cables to satisfy rigorous fire safety tests. As a result, plenum cables are typically constructed to include materials that increase flame resistance, reduce smoke generation, and/or limit flame spread.

Depending on the design of a cable, a wide variety of different components may be included, such as insulation layers, separators, buffer tubes, tapes or wraps, and/or cable jackets. Each components of the cable can affect the flame performance of the overall cable. Conventional cables typically include components that are formed from relatively expensive materials, such as fluorinated ethylene propylene ("FEP"). In higher pair count cables, it is often necessary to utilize even more expensive jacket materials, such as FEP or polyvinylidene fluoride ("PVDF") jacket materials. However, the high cost of these materials makes their use less desirable, and a wide variety of attempts have been made to reduce the amount of these materials incorporated into cables while still satisfying desired electrical performance criteria.

The use of lower cost insulation materials, such as polypropylene ("PP"), high-density polyethylene ("HDPE"), and medium-density polyethylene ("MDPE"), typically results in greater flame spread and higher smoke generation when subjected to plenum burn test. As a result, it is often not desirable to use these materials in plenum cables. However, there is an opportunity for flame retardant insulation materials that can be utilized to form components within plenum cables. There is also an opportunity for improved insulation materials that are less expensive than conventional flame retardant materials, such as solid FEP or PVDF.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
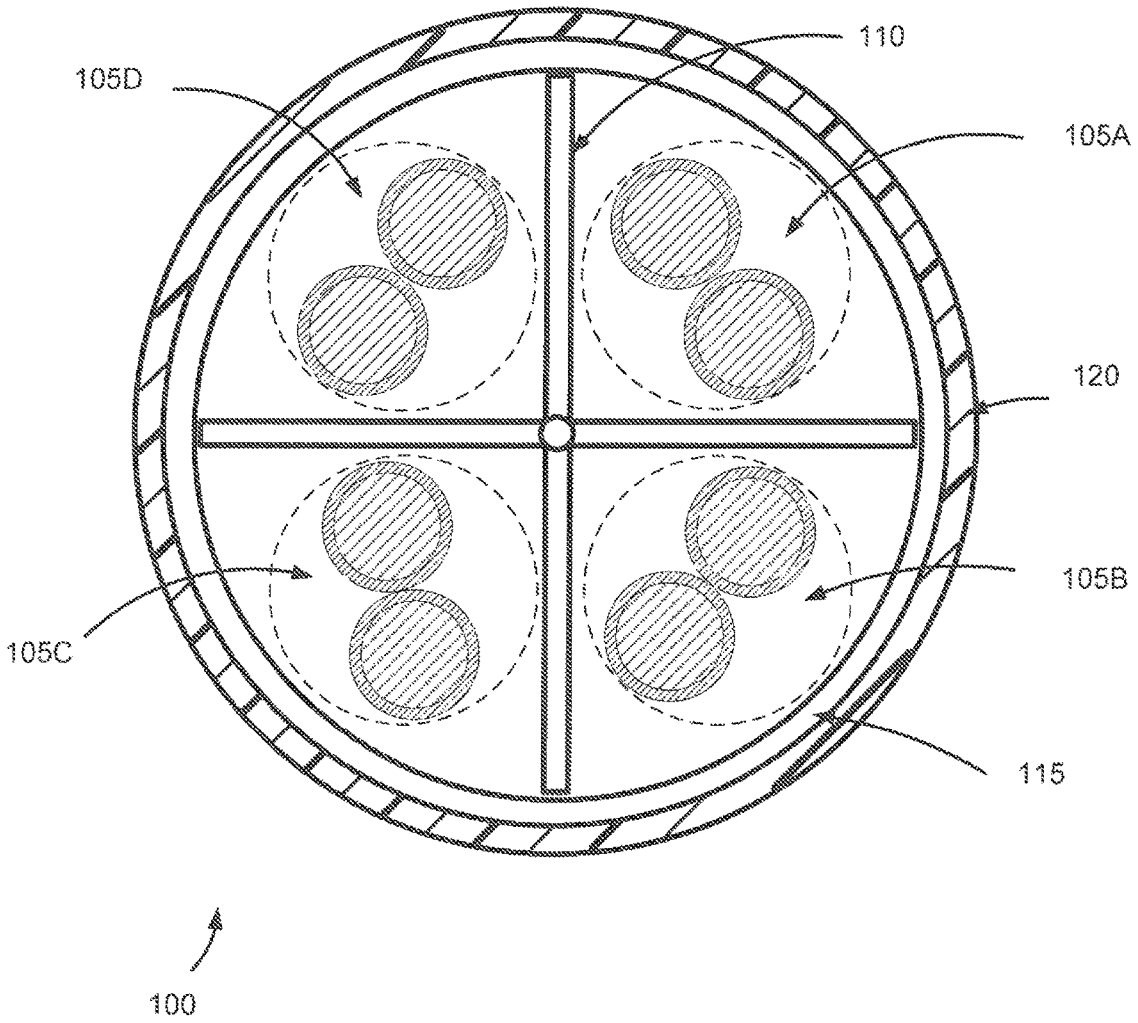
FIG. 1 is a cross-sectional view of an example twisted pair cable incorporating at least one component formed from a flame retardant insulation material, according to an illustrative embodiment of the disclosure.

Various embodiments of the present disclosure are directed to insulation materials for use in plenum-rated cables, such as plenum-rated communications cables. Other embodiments of the disclosure are directed to cable components formed from the insulation materials, as well as cables that incorporate such components. In one example embodiment, an insulation material may be formed from a base polymeric material and a polymeric filler that is blended or mixed with the base material. The base material, which may be formed from a single material or any suitable combination of materials, may have a first melting point. The melting point of the base material may be lower than a temperature at which the insulation material is extruded in order to form a cable component. The polymeric filler material may have a second melting point that is greater than or higher than the temperature at which the insulation material is extruded. In other words, when the insulation material is extruded, the base material will exist in a molten state while the filler is not melted. Additionally, the base material and the filler material will not be compounded or chemically bonded together.

A wide variety of suitable materials may be utilized to form the polymeric base, such as polyvinyl chloride (PVC), polyethylene (PE), polypropylene (PP), chlorinated polyethylene (CPE), nylon, polyester, and/or polybutylene terephthalate (PBT). Additionally, a wide variety of suitable materials may be utilized as filler materials, such as fluorinated ethylene propylene (FEP), polyvinylidene fluoride (PVDF), perfluoroalkoxy alkane (PFA), and/or polytetrafluoroethylene (PTFE). In certain embodiments, a non-polymeric filler material, such as talc, may be used in addition to or as an alternative to a polymeric filler.

Additionally, any number of cable components may be formed from an insulation material that includes a polymeric base material and a polymeric filler. Examples of suitable cable components include, but are not limited to, an outer cable jacket, an interior jacket, a cable wrap, a twisted pair separator or filler, a separator positioned between the individual conductors of a twisted pair, a buffer tube, a microtube, a tight buffer, etc. A few non-limiting examples of cable components are discussed in greater detail below with reference to FIGS. 1-5. Additionally, these components may be utilized in a wide variety of different types of cables including, but not limited to, optical fiber cables, twisted pair cables, hybrid or composite cables (e.g., cables including a combination of conductors and optical fibers), and/or other communication cables. In certain embodiments, these components may be flame retardant and/or smoke suppressant, thereby making them suitable for use in plenum cables.

Certain example embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1-5 illustrate example cable constructions in which one or more cable components may be formed from an insulation material that includes a polymeric base and a polymeric filler. The described cables are provided by way of non-limiting example only, and it will be appreciated that a wide variety of other suitable cable components may be formed in addition to those described. Further, a wide variety of other cable constructions, such as composite or hybrid cables, may incorporate components formed from a polymeric base combined with a polymeric filler.

Turning now to FIG. 1, a cross-sectional view of an example twisted pair cable 100 is illustrated. According to an aspect of the disclosure, the twisted pair cable 100 may include one or more components formed from an insulative or dielectric material having a polymeric base combined with a polymeric filler. For example, the cable 100 may include an outer jacket, a twisted pair separator, a separator positioned between conductors of a twisted pair, conductor insulation, and/or any other suitable component(s) formed from a suitable insulation material having both a polymeric base and a polymeric filler.

The cable 100 may include any number of twisted pairs of individually insulated conductors, such as the four twisted pairs 105A-D illustrated in FIG. 1. Each twisted pair (generally referred to as twisted pair 105) can carry data or some other form of information, for example in a range of about one to ten Giga bits per second ("Gbps") or another appropriate frequency, whether faster or slower. A twisted pair 105 may include two electrical conductors, each covered with suitable insulation. As desired, each of the twisted pairs 105A-D may have the same twist lay length or alternatively, at least two of the twisted pairs may include a different twist lay length. For example, different twist lay lengths may function to reduce crosstalk between the twisted pairs 105A-D. The electrical conductors may be formed as solid or stranded conductors from any suitable electrically conductive material or combinations of material, such as copper, aluminum, silver, annealed copper, gold, or a conductive alloy. Additionally, the electrical conductors may have any suitable diameter, gauge, and/or other dimensions.

The insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), etc.), one or more polyesters, polyvinyl chloride ("PVC"), one or more flame retardant olefins, a low smoke zero halogen ("LSZH") material, etc.), etc. Additionally, the insulation may be formed from any number of layers (e.g., single layer, multilayer, etc.). In the event that multiple layers are used, each of the layers may be formed from the same material(s) or, alternatively, at least two layers may be formed from different materials. Additionally, as desired, the insulation may be formed to include one or more layers of foamed material. The insulation may also include any number of additives or other materials, such as a flame retardant material and/or a smoke suppressant material. In certain embodiments, the insulation or a portion of the insulation (e.g., a layer of insulation, etc.) formed on one or both of the conductors of a twisted pair 105 may include a polymeric base material and at least one polymeric filler that has been mixed or blended with the polymeric base material.

In certain embodiments, each of the conductors of a twisted pair 105 may be covered with the same type of insulation. In other embodiments, different insulation constructions may be utilized for each of the conductors. Additionally, in certain embodiments, each of the twisted pairs 105A-D may be formed with similar constructions. For example, each of the twisted pairs 105A-D may include conductors that are insulated with the same material or combination of materials. In other embodiments, at least two of the twisted pairs may be formed with different constructions. For example, a first twisted pair may include insulation that incorporates a dielectric filler while a second twisted pair does not include a dielectric filler.

Additionally, in certain embodiments, a flexible member or separator 110 may be provided between one or more twisted pairs 105A-D, and the separator 110 may assist in maintaining a desired orientation and/or desired positioning of one or more twisted pairs 105A-D. A separator 110 may be formed from a wide variety of suitable materials, such as polypropylene, PVC, polyethylene, FEP, ethylene chlorotrifluoroethlyene ("ECTFE"), or some other suitable polymeric or dielectric material. In certain embodiments, a separator 110 may be at least partially formed from a polymeric base material that has been combined with at least one polymeric filler material. As desired, a separator 110 may be filled, unfilled, foamed, un-foamed, homogeneous, or inhomogeneous and may or may not include additives (e.g., smoke suppressants, etc.). In certain embodiments, the separator 110 may include electrically conductive material (e.g., electrically conductive patches, embedded electrically conductive material, etc.) that provide shielding for one or more of the twisted pairs 105A-D. Additionally, in various embodiments, a separator 110 may be continuous along a longitudinal length of the cable 100 or discontinuous (i.e., formed with a plurality of discrete or separator sections) along a longitudinal length of the cable 100.

A separator 110 may be formed in accordance with a wide variety of suitable dimensions, shapes, or designs. For example, a rod-shaped separator, a flat tape separator, a flat separator, an X-shaped or cross-shaped separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized. In certain embodiments, material may be cast or molded into a desired shape to form a separator 110. In other embodiments, a tape may be formed into a desired shape utilizing a wide variety of folding and/or shaping techniques. For example, a relatively flat tape separator may be formed into an X-shape or cross-shape as a result of being passed through one or more dies.

Twisted pairs 105A-D may be shielded or unshielded as desired in various embodiments. As shown, an overall shield 115 may be formed around all of the twisted pairs 105A-D. In other embodiments, twisted pairs 105A-D may be individually shielded or groups of twisted pairs may be shielded. A shield may be formed as either a continuous shield (e.g., a metallic foil shield, a braided shield, etc.) or as a discontinuous shield that includes patches of electrically conductive material. A discontinuous shield may include electrically conductive patches having any suitable shape(s) and/or dimensions (e.g., lengths, etc.). Additionally, spaces or gaps formed between adjacent patches may have any suitable widths. In certain embodiments, a series of microcuts (e.g., a plurality of gaps less than approximately 0.25 inches, etc.) may be formed between adjacent patches. Additionally, in certain embodiments, an electrically conductive patch may be shorted to itself along a circumferential direction when a shield layer is formed. Shield layers may also be formed from a plurality of overlapping segments (e.g., a fish scale type of arrangement, etc.) in certain embodiments. Indeed, a wide variety of shielding arrangements are available for twisted pair conductors.

In certain embodiments, a shield layer may be formed from both dielectric material and electrically conductive material. For example, electrically conductive patches may be formed on a dielectric substrate. Any number of dielectric layers and/or electrically conductive layers may be utilizes. Additionally, a wide variety of suitable electrically conductive (e.g., copper, aluminum, silver, annealed copper, gold, a conductive alloy, etc.) and/or dielectric materials (e.g., polymeric materials, etc.) may be utilized. In certain embodiments, a substrate layer may be formed at least in part from a polymeric base material that has been combined with at least one polymeric filler, although other suitable constructions may be utilized.

A jacket 120 may be formed around the internal components of the cable 100, and the jacket 120 may define one or more cable cores. The jacket 120 may include a single layer or, alternatively, multiple layers of material (i.e., multiple layers of the same material, multiple layers of different materials, etc.). As desired, the jacket 120 may be characterized as an outer sheath, a casing, a circumferential cover, or a shell. The jacket 120 may be formed from a wide variety of suitable materials, such as a polymeric material, polyvinyl chloride ("PVC"), polyurethane, one or more polymers, a fluoropolymer, polyethylene, medium density polyethylene ("MDPE"), neoprene, cholorosulphonated polyethylene, polyvinylidene fluoride ("PVDF"), polypropylene, modified ethylene-chlorotrifluoroethylene, fluorinated ethylene propylene ("FEP"), ultraviolet resistant PVC, flame retardant PVC, low temperature oil resistant PVC, polyolefin, flame retardant polyurethane, flexible PVC, low smoke zero halogen ("LSZH") material, plastic, rubber, acrylic, or some other appropriate material known in the art, or a combination of suitable materials. As desired, the jacket 120 may also include flame retardant materials, smoke suppressant materials, carbon black or other suitable material for protection against exposure to ultraviolet ("UV") light, and/or other suitable additives. In certain embodiments, the jacket 120 (or a layer or portion of the jacket 120) may be formed from a polymeric base material that has been combined with and/or blended with one or more filler materials, such as one or more dielectric filler materials.

The jacket 120 may enclose one or more openings in which other components of the cable 100 are disposed. At least one opening enclosed by the jacket 120 may be referred to as a cable core, and any number of other cable components may be disposed in a cable core. In the cable 100 illustrated in FIG. 1, the twisted pairs 105A-D, separator 110, and shield 115 are situated within a cable core. A wide variety of other components may be situated within a cable core as desired, such as other transmission media, tubes, spacers, inner jackets or wraps, etc. Indeed, a wide variety of different cable constructions may be utilized in accordance with various embodiments of the disclosure.

Additionally, the illustrated cable 100 has a circular or approximately circular cross-sectional profile. In other embodiments, other cross-sectional profiles (e.g., an elliptical or oval profile, etc.) and/or dimensions may be utilized as desired. In other words, the jacket 120 may be formed to result in any desired shape. The jacket 120 may also have a wide variety of dimensions, such as any suitable or desirable outer diameter and/or any suitable or desirable wall thickness. Additionally, in certain embodiments, the cable profile may be formed to facilitate a specific function and/or to facilitate installation of the cable. For example, a cable profile may facilitate duct or conduit installation, and the cable 100 may be designed to withstand a specified installation tensile loading and/or other suitable design parameters.

In certain embodiments, at least one "rip cord" may be incorporated into the cable 100, for example, within a cable core. A ripcord may facilitate separating the jacket 120 from other components of the cable 100. In other words, the rip cord may help open the cable 100 for installation or field service. A technician may pull the ripcord during installation in order to access internal components of the cable 100.

A wide variety of other materials may be incorporated into the cable 100 as desired. For example, in certain embodiments, a respective dielectric separator or demarcator (not shown) may be positioned between the individual conductive elements or electrical conductors of one or more of the twisted pairs 105A-D. In certain embodiments, a dielectric separator may be woven helically between the individual conductors or conductive elements of a twisted pair 10. In other words, the dielectric separator may be helically twisted with the conductors of the twisted pair 105 along a longitudinal length of the cable 100. In certain embodiments, the dielectric separator may maintain spacing between the individual conductors of the twisted pair 105 and/or maintain the positions of one or both of the individual conductors. For example, the dielectric separator may be formed with a cross-section (e.g., an X-shaped cross-section, an H-shaped cross-section, etc.) that assists in maintaining the position(s) of one or both the individual conductors of the twisted pair 105. In other words, the dielectric separator may reduce or limit the ability of one or both of the individual conductors to shift, slide, or otherwise move in the event that certain forces, such as compressive forces, are exerted on the cable 100. In other embodiments, a dielectric separator may be formed as a relatively simple film layer that is positioned between the individual conductors of a twisted pair 105. A dielectric separator may be formed from a wide variety of suitable dielectric materials, such as veracious polymeric materials. In certain embodiments, a dielectric separator may be formed from a polymeric base material that has been combined with one or more polymeric fillers.

Figure 2:
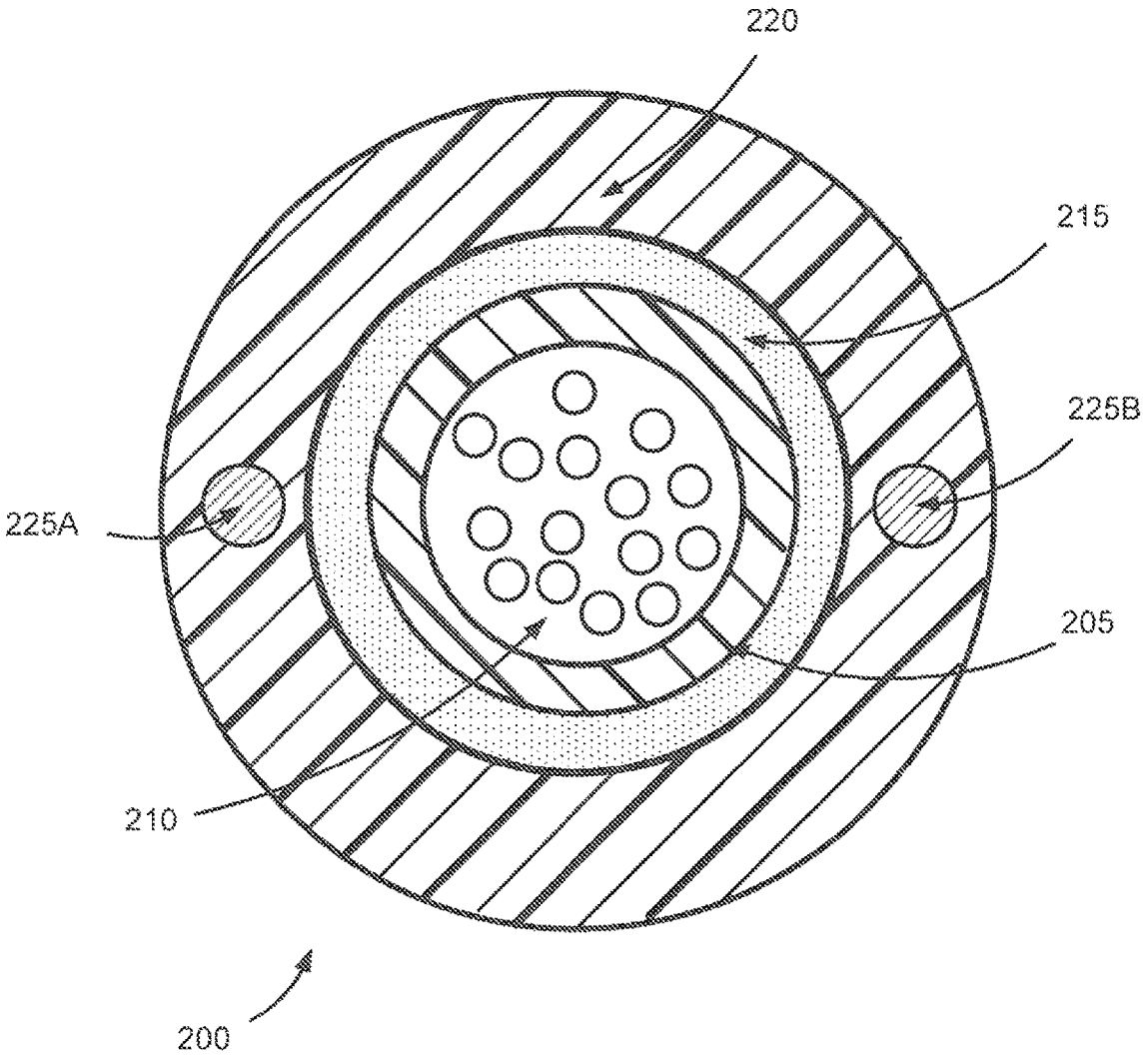
FIG. 2-5 are cross-sectional views of example optical fiber cables that each incorporate at least one component formed from a flame retardant insulation material, according to illustrative embodiments of the disclosure.

Turning now to FIG. 2, a cross-sectional view of an example optical fiber cable 200 is illustrated. The illustrated cable 200 may have a single buffer tube 205, and any number of optical fibers 210 may be disposed within the buffer tube 205. In certain embodiments, a water blocking layer 215 and/or a strength layer may be formed around the buffer tube 205. An outer jacket 220 may then be formed around the internal components of the cable 200. As desired, other cable designs, such as the cable illustrated in FIG. 3, may include a plurality of buffer tubes as well as any number of other cable components.

The buffer tube 205 may be situated within a cable core defined by the outer jacket 220, and the buffer tube 205 may be configured to contain or house optical fibers, such as the illustrated optical fibers 210. Additionally, the buffer tube 205 may be formed from a wide variety of suitable materials and/or combinations of materials, such as various polymeric materials, nucleated polymeric materials, etc. In certain embodiments, the buffer tube may be formed from a material that includes a polymeric base combined with one or more polymeric fillers. Additionally, the buffer tube 205 may be formed as either a single layer or a multiple layer buffer tube. In the event that multiple layers are utilized, the layers may all be formed from the same material(s) or, alternatively, at least two layers may be formed from different materials or combinations of materials. For example, at least two layers may be formed from different polymeric resins. As another example, a flame retarding or other suitable filler may be incorporated into a first layer but not into a second layer. Further, the buffer tube 205 may have any suitable inner and/or outer diameters as desired in various applications.

Any number of optical fibers, other transmission elements, and/or other components may be positioned within the buffer tube 205. In certain embodiments, optical fibers may be loosely positioned in a tube, wrapped or bundled together, or provided in one or more ribbons. FIG. 2 illustrates loose optical fibers 210 positioned in the buffer tube 205. In certain embodiments, water-blocking material (e.g., a water blocking gel, grease, etc.) may also be provided within the buffer tube 205. Alternatively, a buffer tube may be filled with a gas, such as air, powder, a moisture absorbing material, a water-swellable substance, dry filling compound, or foam material, for example in interstitial spaces between the optical fibers 210.

Each optical fiber 210 utilized in the cable 200 may be a single mode fiber, multi-mode fiber, multi-core fiber, or some other optical waveguide that carries data optically. Additionally, each optical fiber may be configured to carry data at any desired wavelength (e.g., 1310 nm, 1550 nm, etc.) and/or at any desired transmission rate or data rate. The optical fibers may also include any suitable composition and/or may be formed from a wide variety of suitable materials capable of forming an optical transmission media, such as glass, a glassy substance, a silica material, a plastic material, or any other suitable material or combination of materials. Each optical fiber may also have any suitable cross-sectional diameter or thickness.

The outer jacket 220 may define an outer periphery of the cable 200. The jacket 220 may enclose the internal components of the cable 200, seal the cable 200 from the environment, and provide strength and structural support. The jacket 220 may be similar to the jacket 120 described in greater detail above with reference to FIG. 1. In certain embodiments, at least one "rip cord" may be incorporated into the cable 200, and a ripcord may facilitate separating the jacket 220 from other components of the cable 200.

Figure 3:
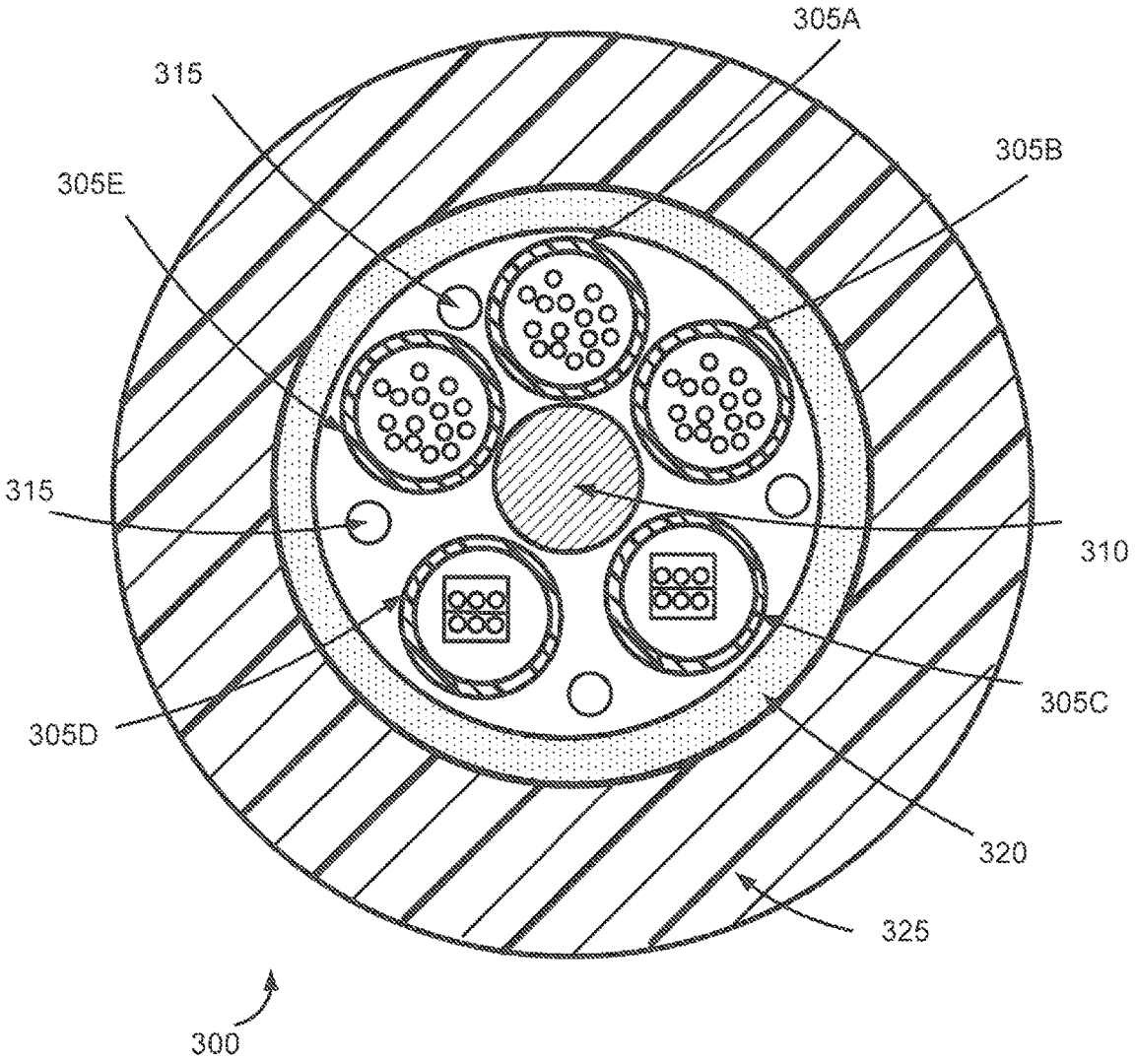
Figure 4:
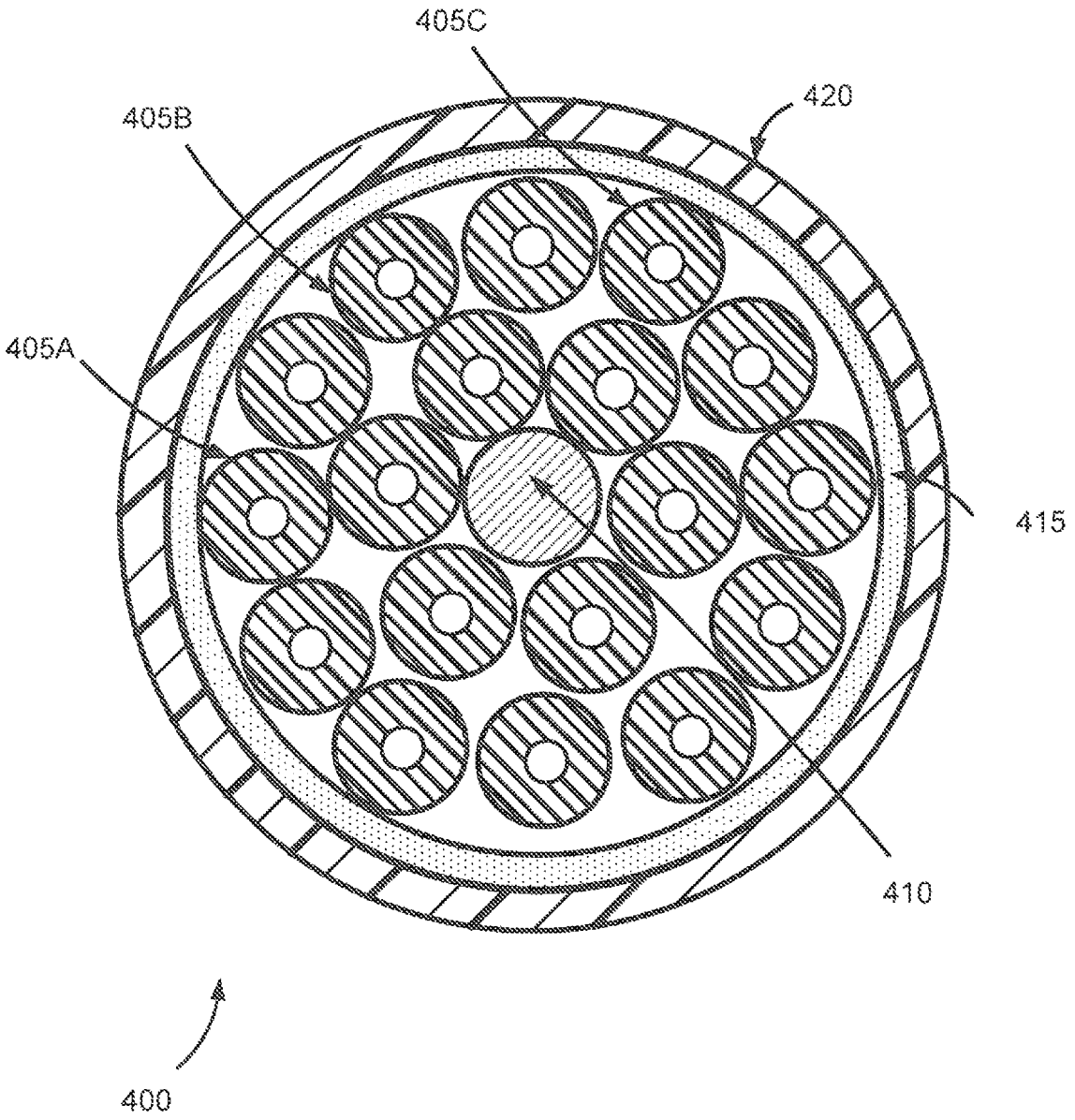

As desired, any number of strength members may be incorporated into the cable 200 at a wide variety of suitable locations. In certain embodiments, one or more strength members 225A, 225B may be embedded in the jacket 220. For example, the jacket 220 may be formed or extruded around one or more strength members 225A, 225B. Embedded strength members 225A, 225B may be located at any desired points within the jacket 220. For example, the strength members 225A, 225B may be located on opposing lateral sides of a longitudinal axis of the cable 200. The strength members 225A, 225B may enhance tensile strength of the cable 200. In other embodiments, one or more strength members may be situated within a cable core, as illustrated in FIGS. 3 and 4. Indeed, a wide variety of strength member configurations may be utilized.

In certain embodiments, the cable 200 may include an armor (not shown) inside the jacket 220. The armor may provide mechanical (e.g., rodent resistance, etc.) and/or electrical protection for transmission media situated within the cable core. The armor may be formed from a wide variety of suitable materials, such as a metal (e.g., steel, a copper alloy, etc.) tape that is formed into a tube, fiberglass, glass, epoxy, and/or appropriate polymeric materials. In certain embodiments, the armor may be formed as an interlocking armor or a corrugated armor.

Figure 5:
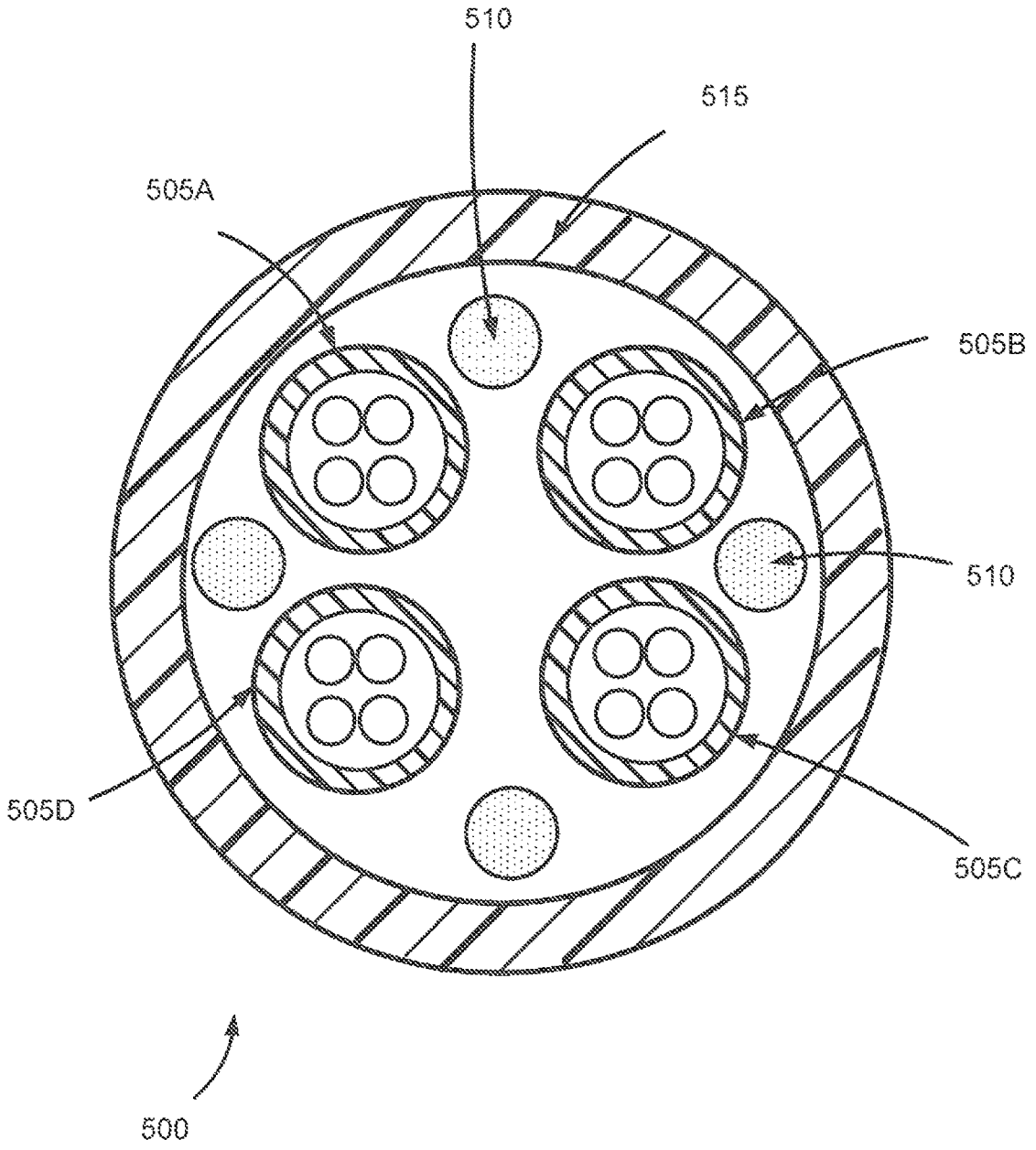

As desired, the cable 200 may also include water swellable materials or water dams for impeding flow of any water that inadvertently enters the cable 200, for example due to damage of the outer jacket 220. Upon contact with water, water swellable materials may absorb the water and swell, helping to prevent the water from damaging the optical fibers. Impeding the longitudinal flow of water also helps confine any fiber damage to facilitate repair. Accordingly, water dams may help to limit water damage. As shown in FIG. 2, a water swellable tape or wrap 215 may be positioned in a cable core and wrapped around one or more other cable components, such as the buffer tube 210. In other embodiments and as illustrated in FIGS. 3 and 5, one or more water swellable materials (e.g., water swellable yarns, etc.) may be positioned in interstices between core components, such as between one or more buffer tubes or between one or more buffer tubes and a cable jacket. In yet other embodiments, individual core components may be partially or completely wrapped with water swellable materials. As desired in various embodiments, water swellable materials may be provided in a continuous or discontinuous manner along a longitudinal length of the cable 200. Additionally or alternatively, water blocking material (e.g., water blocking dams) may be intermittently incorporated into the cable core. A wide variety of suitable water blocking materials and/or combinations of materials may be utilized as desired.

FIG. 3 is a cross-sectional view of another example cable 300 that may include one or more components formed from a polymeric base material combined with a polymeric filler, according to an illustrative embodiment of the disclosure. The cable 300 of FIG. 3 may include certain components that are similar to the cable 200 of FIG. 2; however, the cable 300 of FIG. 3 may include a plurality of buffer tubes 305A-E rather than a single buffer tube. As shown, a plurality of buffer tubes 305A-E may be situated around a central strength member 310. Although five buffer tubes 305A-E are illustrated, any number of buffer tubes can be utilized. In other embodiments, the buffer tubes 305A-E may be situated around a central tube, a central group of twisted pairs, or other central cable component(s)). Additionally, although a single ring of buffer tubes 305A-E is illustrated, in other embodiments, multiple rings of buffer tubes may be utilized. As desired, one or more of the buffer tubes 305A-E may be replaced with other components, such as strength members or spacers. Indeed, a wide variety of suitable buffer tubes arrangements may be utilized.

Each of the buffer tubes 305A-E may be situated within a cable core. The buffer tubes 305A-E may be loosely positioned within the core or, alternatively, stranded or twisted together. Any number of transmission media, such as optical fibers, optical fiber ribbons, and/or twisted pairs, may be situated within one or more of the buffer tubes 305A-E. Each buffer tube may be filled or unfilled as desired. Additionally, in certain embodiments, one or more water blocking components, such as water blocking yarns 315 and/or a water blocking tape 320 or wrap may also be positioned within the cable core. An outer jacket 325 may then be formed around the internal cable components, and the outer jacket 325 may define the cable core (or multiple cores).

Each of the components illustrated in the cable 300 of FIG. 3 may be similar to the components previously described with reference to FIG. 2 above. Additionally, at least one of the components may be formed from and/or incorporate a material that includes a polymeric base combined with a polymeric filler. For example, one or more of the buffer tubes 305A-E may be formed from a polymeric base material combined with a polymeric filler. As another example, the outer jacket 325 (or an internal jacket or wrap layer) may incorporate a polymeric base material combined with a polymeric filler.

FIG. 4 is a cross-sectional view of another example cable 400 that may include one or more components formed from a polymeric base material combined with a polymeric filler, according to an illustrative embodiment of the disclosure. The cable 400 of FIG. 4 may include certain components that are similar to the cables 200, 300 of FIGS. 2 and 3; however, the cable 400 of FIG. 4 may include a plurality of tight-buffered optical fibers 405A, 405B, 405C, etc. rather than one or more buffer tubes in which optical fibers may be situated. As shown, a plurality of tight-buffered optical fibers, such as fibers 405A, 405B, 405C, may be situated around a central strength member 410. Any number of tight-buffered optical fibers may be incorporated into the cables as desired, and theses fibers may be arranged into any number of rings or groupings. As desired in other embodiments, the optical fibers may be situated around a central tube, a central group of twisted pairs, or other central cable component(s)). Additionally, in certain embodiments, one or more of the optical fibers may be replaced with other components, such as strength members, spacers, or buffer tubes. Indeed, a wide variety of suitable tight-buffered optical fiber arrangements may be utilized.

A tight-buffered optical fiber may be formed by applying or forming a cover, jacket, or buffer layer over an individual optical fiber. These buffer layers protect the fiber from physical damage and limit microbending of the fiber. A tight-buffer layer may be formed from any number of suitable materials and/or combinations of materials, such as a wide variety of polymeric materials. In certain embodiments, a tight-buffer layer may be formed from a polymeric base material combined with at least one polymeric filler. Additionally, in certain embodiments, a plurality of tight-buffered fibers may be stranded or twisted together within a cable core. Indeed, a wide variety of different optical fiber arrangements may be utilized as desired in various embodiments.

Additionally, in certain embodiments, one or more water blocking components, such as water blocking yarns and/or a water blocking tape 415 or wrap may also be positioned within the cable core. An outer jacket 420 may then be formed around the internal cable components, and the outer jacket 420 may define the cable core (or multiple cores). Each of the components illustrated in the cable 400 of FIG. 4 may be similar to the components previously described with reference to FIGS. 2 and 3 above. Additionally, at least one of the components (e.g., a tight-buffer layer, a jacket, etc.) may be formed from and/or incorporate a polymeric base material combined with at least one polymeric filler.

FIG. 5 is a cross-sectional view of another example cable 500 that may include one or more components formed from a polymeric base material combined with a polymeric filler, according to an illustrative embodiment of the disclosure. The cable 500 of FIG. 5 may include certain components that are similar to the cables 200, 300, 400 of FIGS. 2-4; however, the cable 500 of FIG. 5 may include a plurality of optical fiber microtubes rather than one or more buffer tubes and/or tight-buffered optical fibers. Any number of microtubes, such as the four illustrated microtubes 505A-D, may be situated within a cable core. As desired, the microtubes may be loosely positioned within a cable core; situated around a central strength member, tube, or other component; or stranded or twisted together within a cable core. Additionally, in certain embodiments, one or more of the microtubes may be replaced with other components, such as strength members, spacers, etc. Indeed, a wide variety of suitable microtube arrangements may be utilized.

Each microtube (generally referred to as microtube 505) may house any desired number of optical fibers, such as two, three, four, eight, twelve, or some other number of optical fibers. The microtube 505 may have a single layer or multi-layer construction, and the microtube 505 may be formed from any suitable material or combination of materials. In certain embodiments, the microtube 505 (or at least one layer of the microtube 505) may be formed from a polymeric base material that has been combined with at least one polymeric filler. Additionally, as desired, a microtube 505 may have an inner diameter that is sized to allow the optical fibers to move relative to one another while preventing the optical fibers from crossing over or overlapping one another. In other words, the microtube 505 may permit the optical fibers to flex or move as the cable is flexed or bent while simultaneously maintaining the position of each optical fiber relative to the other optical fibers. In certain embodiments, an inner diameter of the microtube 505 may be determined based at least in part on the number of optical fibers to be positioned within the microtube 505 and/or the outer diameters of the optical fibers. As a result of using one or more microtubes 505, it may be possible to reduce or minimize the diameter of the cable 500 relative to cables that incorporate loose buffer tubes.

Additionally, in certain embodiments, one or more water blocking components, such as water blocking yarns 510 and/or a water blocking tape or wrap may also be positioned within the cable core. An outer jacket 515 may then be formed around the internal cable components, and the outer jacket 515 may define the cable core (or multiple cores). Each of the components illustrated in the cable 500 of FIG. 5 may be similar to the components previously described with reference to FIGS. 2-4 above. Additionally, at least one of the components (e.g., a microtube, etc.) may be formed from and/or incorporate a polymeric base material combined with a polymeric filler.

Although FIGS. 1-5 illustrate twisted pair and optical fiber cables, embodiments of the disclosure are equally applicable to plenum cables and/or other types of cables that incorporate other types of transmission media, such as, coaxial conductors, power conductors, etc. Embodiments of the disclosure are also applicable to hybrid or composite cables that include multiple types of transmission media.

The cables 100, 200, 300, 400, 500 illustrated in FIGS. 1-5 are provided by way of example only to illustrate a few cable constructions in which one or more components may be formed from a polymeric base material combined with at least one polymeric filler. A wide variety of other components may be incorporated into a cable as desired in other embodiments. For example, as set forth above, a cable may include an internal wrap or jacket, a binding layer, a wide variety of suitable transmission media, a wide variety of different types of tubes, spacers, strength members, water blocking materials, water swellable materials, insulating materials, dielectric materials, flame retardants, flame suppressants or extinguishants, gels, fillers, and/or other materials. Additionally, a cable may be designed to satisfy any number of applicable cable standards. These standards may include various operating environment requirements (e.g., temperature requirements), signal performance requirements, burn testing requirements, etc.

In accordance with an aspect of the disclosure and regardless of the types of transmission media utilized in a cable, at least one component of the cable may be formed from an insulation or dielectric material that includes a combination of a polymeric base and at least one polymeric filler. Examples of cable components that may be formed in such a manner include, but are not limited to, outer jackets, inner jackets, separators or fillers, separators positioned between the conductors of twisted pairs, buffer tubes, tight-buffer layers, microtubes, dielectric portions of shielding layers, tapes or wraps, etc. As explained in greater detail below, the use of a dielectric material that combines a polymeric base and a polymeric filler may provide a relatively flame retardant and/or smoke suppressant material that satisfies applicable plenum cable burn standards while maintaining desired electrical performance characteristics. Additionally, the dielectric material may be more cost effective and/or relatively easier to process than conventional plenum rated materials.

Figure 6:
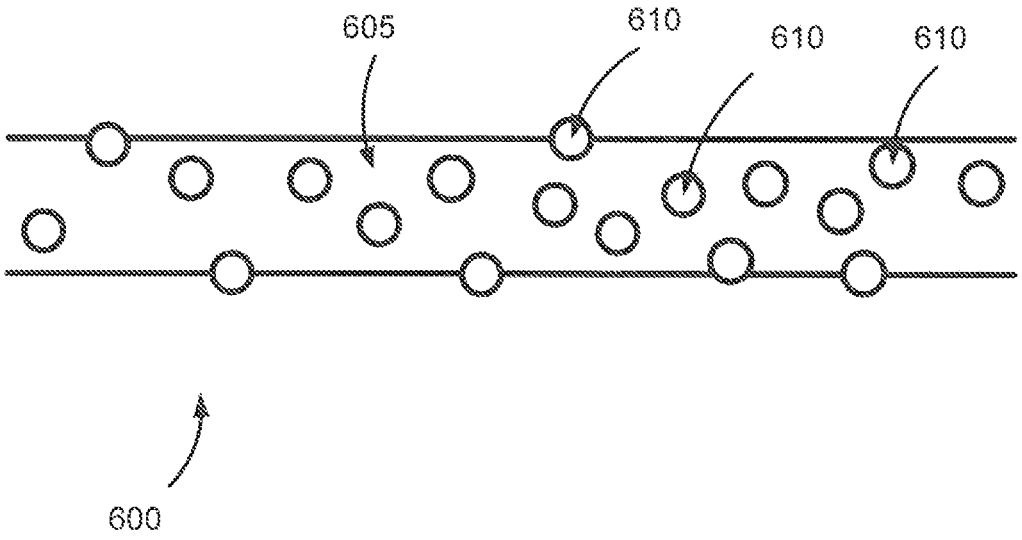
FIG. 6 is a cross-sectional view of an example insulation material that may be incorporated into a cable, according to an illustrative embodiment of the disclosure.

FIG. 6 illustrates a cross-sectional view of an example insulation or dielectric material 600 that may be incorporated into a cable and/or utilized in the construction of one or more cable components. According to an aspect of the disclosure, the insulation material 600 may include a base material 605 that has been combined or blended with a suitable filler material 610. As shown, the particles or components of the filler material 610 may be blended throughout the base material 605. In other embodiments, the filler material 610 may be otherwise mixed or combined with the base material 605. For example, the filler material 610 may be blended with certain portions or in certain areas of the base material 605. As one example, the filler material 610 may be concentrated at or near a surface of the base material 605. In other example embodiments, different concentrations of the filler material 610 may be situated in different portions of the base material 605. Indeed, the filler material 610 and the base material 605 may be mixed or combined in a wide variety of suitable configurations.

The base material 605 may include a wide variety of suitable materials and/or components. In certain embodiments, the base material may be a polymer base formed from one or more suitable polymeric materials. Examples of suitable polymeric materials that may be utilized include, but are not limited to, polyvinyl chloride (PVC), polyethylene (PE), polypropylene (PP), chlorinated polyethylene (CPE), nylon, polyester, and/or polybutylene terephthalate (PBT). In certain embodiments, the base material 605 may be formed from a single polymeric material. In other embodiments, the base material 605 may be formed from a combination of polymeric materials, for example, a copolymer (e.g., a copolymer of PP and PE, etc.).

Additionally, a wide variety of suitable materials may be utilized as filler materials 610. In certain embodiments, at least one filler material 610 may be a polymeric material. A wide variety of suitable polymeric materials may be utilized as desired to form a filler 610 including, but not limited to, fluorinated ethylene propylene (FEP), polyvinylidene fluoride (PVDF), perfluoroalkoxy alkane (PFA), and/or polytetrafluoroethylene (PTFE). In certain embodiments, one or more non-polymeric filler materials, such as talc, may be used in addition to or as an alternative to a polymeric filler. Regardless of the type of filler material(s) utilized, the filler material(s) 610 may be relatively flame retardant and/or smoke suppressant materials. In this regard, an insulation material 600 and/or component formed from the insulation material 600 may exhibit improved flame performance as a result of including the filler material(s) 610. Additionally, the use of the filler material(s) 610 may contribute to a cable component and/or cable satisfying one or more suitable plenum cable standards and/or requirements.

In certain embodiments, a filler material 610 may be formed as a plurality of particles or particulate material. In certain embodiments, the filler material 610 may exist in a powder form that may be blended with the base material 605. In other embodiments, the filler material 610 may exist as microspheres that may be blended with the base material 605. Additionally, the various particles may have any desired dimensions and/or sizes. For example, the particles may have diameters between approximately 10 microns and approximately 20 microns. As another example, the particles may have diameters of approximately 10 microns, 15 microns, 20 microns, 30 microns, 40 microns 50 microns, diameters included in a range between any two of the above values, diameters smaller than approximately 10 microns, or diameters greater than approximately 50 microns.

In certain embodiments, the particles of a filler material 610 may be formed of a single material. For example, with an FEP filler material, each of the particles of the filler material may be formed from substantially all FEP. In other embodiments, at least a portion of the particles of a filler material 610 may be formed from multiple materials. For example, a particle may have a core formed from a first material, and one or more coatings of another material may be applied over the core. As another example, a particle may be formed with multiple layers, and at least two layers may be formed from different materials. Indeed, the particles of a filler material 610 may have a wide variety of suitable constructions.

According to an aspect of the disclosure, the base material 605 may have a first melting point, and the melting point of the base material 605 may be lower than a temperature at which the insulation material 600 is extruded to form a cable component. Additionally, the polymeric filler material 610 may have a second melting point that is greater than or higher than the temperature at which the insulation material 600 is extruded. In other words, when the insulation material 600 is extruded, the base material 605 will be melted and exist in a molten state while the filler material 610 is not melted and exists in a solid state (e.g., as particulate matter, etc.). As a result, the base material 605 and the filler material 610 will not be compounded or chemically bonded together. In certain embodiments, the base material 605 and the filler material 610 will exists as a physical blend or mixture. Additionally, the filler material 610 may function as an inert flame retardant material.

The insulation material 600 may be formed with a wide variety of suitable ratios of constituent components or ingredients. In other words, a wide variety of different mix ratios of base material(s) 605 and filler material(s) 610 may be utilized. In certain embodiments, the filler material 610 may constitute between approximately 0.5 percent (0.5%) and approximately fifty percent (50%) by weight of the insulation material 600. In other embodiments, the filler material 610 may constitute between approximately one percent (1.0%) and approximately fifteen percent (15%) by weight of the insulation material 600. In yet other embodiments, the filler material 610 may constitute between approximately 15% and approximately 30% by weight of the insulation material 600. Other suitable mixing ratios may be utilized in other embodiments. Additionally, the example ranges above can be utilized for a single filler material incorporated into the insulation material 600, a combination of filler materials incorporated into the insulation material 600, and/or individual filler materials included in a combination of filler materials incorporated into the insulation material 600.

A wide variety of suitable processes and/or methods may be utilized as desired to combine a base material with one or more filler materials. In certain embodiments, the base material 605 and the filler material may be physically mixed in their solid states. For example, pelletized materials, spheres or microspheres of materials, particulate matter of the materials, etc. may be physically blended together. In certain embodiments, the base material 605 and filler material(s) 610 may be mixed or blended prior to the extrusion of an insulation material 600 to form a cable component. For example, the base material 605 and filler material(s) 610 may be provided in a pre-blended mixture as a master batch to one or more extrusion devices. In other embodiments, one or more filler material(s) 610 may be added to the base material 605 after the base material 605 has been heated or melted. For example, one or more filler material(s) 610 may be added during an extrusion process (e.g., immediately prior to extrusion, during extrusion, etc.). Regardless of the point in time at which the combination occurs, in certain embodiments, a relatively uniform blending or mixture may be obtained in certain embodiments. In other words, the filler material(s) 610 may be blended throughout the base material 605 in a relatively uniform manner. In other embodiments, a relatively non-uniform blending may occur. For example, the filler material(s) 610 may be concentrated in portions of the base material 605, such as near a surface of the base material 605. Additionally, in certain embodiments (as shown), particles of the filler material 610 may be situated within the base material 605 (e.g., embedded within the base material 605, etc.) and/or at a surface of the base material (e.g., partially embedded within the base material 605, etc.) as desired in various embodiments.

A wide variety of other components may be blended, mixed, or combined with a base material and filler material(s) as desired in various embodiments. These components may include, but are not limited to, one or more low smoke zero halogen ("LSZH") materials, one or more smoke suppressants, one or more antioxidants, one or more plasticizers, one or more reinforcing filler materials or strength materials, one or more ultraviolet ("UV") stabilizers, one or more moisture absorbing and/or water absorbing materials (e.g., absorbent powders, supabsorbent materials, etc.), one or more moisture blocking and/or water blocking materials, one or more slip agents, one or more materials that lower or reduce the coefficient of friction of a modified polymeric resin, one or more materials that reduce the coefficient of thermal expansion of a modified polymeric resin, one or more colarants and/or dies, one or more foaming agents, etc. Indeed, a wide variety of suitable formulations and/or recipes may be utilized to form the insulation material 600.

As a result of forming a cable component from an insulation material or dielectric material that includes a polymeric base and at least one polymeric filler, the cable component may exhibit improved flame retardant and/or smoke suppressant properties relative to other components. As a result, the cable component and/or cable including the cable component may be suitable for use in a plenum space and may satisfy one or more suitable plenum cable standards and/or requirements. Additionally, construction of the cable component may be relatively easier and/or more energy efficient than construction of conventional flame retardant cable components. Conventional cable components, such as a conventional flame retardant jacket, are either constructed entirely of a flame retardant material or, alternatively, have a flame retardant material compounded with other materials. In order to compound and/or extrude the conventional cable component, it is necessary to melt the flame retardant material. Given the higher melting temperature of the flame retardant material, the melting is typically an energy intensive and/or expensive process. Accordingly, energy may be conserved and a corresponding cost savings may be achieved with various embodiments of the present disclosure.

Figure 7:
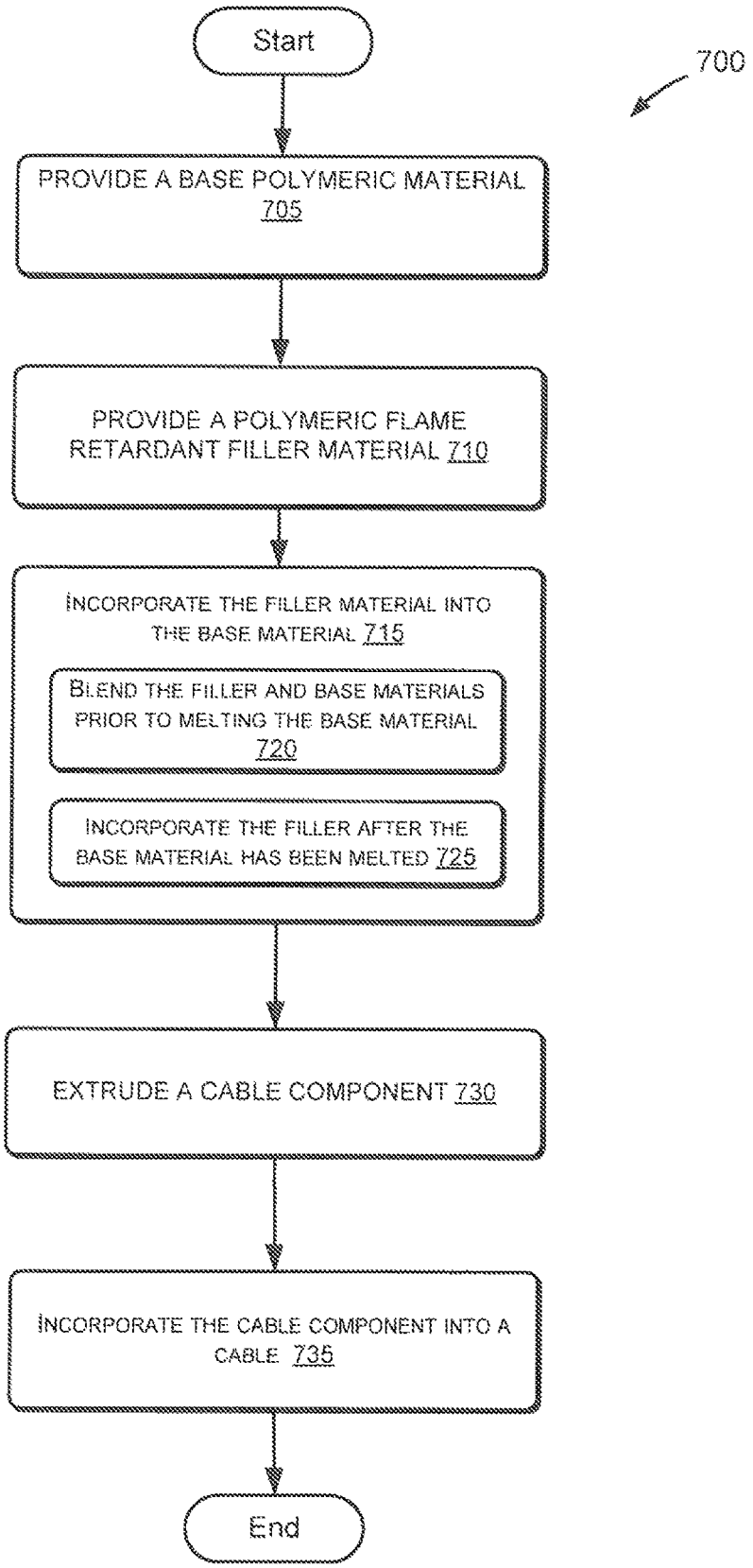
FIG. 7 is a flowchart of an example method for forming a flame retardant insulation material, according to an illustrative embodiment of the disclosure.

FIG. 7 is a flowchart of an example method 700 for forming a cable component from an insulation material that includes a polymeric base and at least one polymeric filler, according to an illustrative embodiment of the disclosure. The method 700 may begin at block 705. At block 705, a polymeric base material may be formulated or otherwise provided. A wide variety of suitable polymeric base materials may be provided as desired in various embodiments. For example, a base material may include polyvinyl chloride (PVC), polyethylene (PE), polypropylene (PP), chlorinated polyethylene (CPE), nylon, polyester, and/or polybutylene terephthalate (PBT). Other suitable polymeric resins may be utilized in other embodiments.

At block 710, at least one polymeric flame retardant filler materials may be provided. A wide variety of suitable polymeric materials may be utilized as desired to form a filler including, but not limited to, fluorinated ethylene propylene (FEP), polyvinylidene fluoride (PVDF), perfluoroalkoxy alkane (PFA), and/or polytetrafluoroethylene (PTFE). In certain embodiments, one or more non-polymeric filler materials, such as talc, may be used in addition to or as an alternative to a polymeric filler.

At block 715, the filler material(s) may be mixed, blended, or otherwise incorporated into the polymeric base material via any number of suitable methods and/or techniques. For example, at block 720, the filler material(s) may be blended with the base material as part of a master batch or other physical mixture prior to the melting of the base material for extrusion. In other words, solid components of the base and filler materials, such as pellets and/or particulate matter, may be physical blended prior to an extrusion process. As another example, at block 725, the filler material(s) may be blended with or incorporated into the base material after the base material has been melted. For example, the filler material(s) may be blended with the base material during an extrusion process or prior to the extrusion process after the base material has been melted. As another example, the filler material(s) may be blended with the base material while the base material is being heated and/or melted. Other suitable blending and/or mixing techniques may be utilized as desired.

At block 730, a cable component may be formed from the mixture of the polymeric base material and filler material(s). For example, the mixture resin may be extruded via any number of suitable extrusion devices (e.g., a single screw extruded, an extrusion die, etc.) in order to form a cable component. Additionally, a wide variety of suitable cable components may be formed as desired in various embodiments including, but not limited to, outer jackets, inner jackets, buffer tubes, tight-buffer layers, microtubes, separators or fillers, separators positioned between the conductors of twisted pairs, dielectric portions of shielding layers, tapes or wraps, etc.

At block 735, the formed cable component may be incorporated into a cable. In certain embodiments, the cable component may be formed in an offline process prior to the construction of the cable, and the component may subsequently be incorporated into the cable. In other embodiments, the cable component may be formed in an inline process during the construction of the cable. As one non-limiting example, an outer jacket may be extruded around one or more twisted pairs during a cable formation process.

The method 700 may end following block 735. The operations described and shown in the method 700 of FIG. 7 may be carried out or performed in any suitable order as desired in various embodiments. Additionally, in certain embodiments, at least a portion of the operations may be carried out in parallel. Furthermore, in certain embodiments, less than or more than the operations described in FIG. 7 may be performed.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

Although specific embodiments have been described above in detail, the description is merely for purposes of illustration. It should be appreciated, therefore, that many aspects described above are not intended as required or essential elements unless explicitly stated otherwise. Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

That which is claimed:

1. An insulation material for use in a plenum-rated communications cable, the insulation material comprising:

a base polymeric material having a first melting point, the first melting point lower than a temperature at which the insulation material is extruded around one or more transmission elements of the cable; and a polymeric filler material blended throughout the base polymeric material, the filler material comprising between 0.5 percent to 50.0 percent by weight of the insulation material and the polymeric filler material having a second melting point greater than the temperature at which the insulation material is extruded, wherein the polymeric filler material comprises at least one of one of fluorinated ethylene propylene (FEP), polyvinylidene fluoride (PVDF), perfluoroalkoxy alkane (PFA), or polytetrafluoroethylene (PTFE).

2. The insulation material of claim 1, wherein the polymeric filler material comprises fluorinated ethylene propylene (FEP).

3. The insulation material of claim 1, wherein the polymeric filler material comprises at least one of polyvinylidene fluoride (PVDF), perfluoroalkoxy alkane (PFA), or polytetrafluoroethylene (PTFE).

4. The insulation material of claim 1, wherein the base polymeric material comprises at least one of polyvinyl chloride (PVC), polyethylene (PE), polypropylene (PP), chlorinated polyethylene (CPE), nylon, polyester, or polybutylene terephthalate (PBT).

5. The insulation material of claim 1, wherein the polymeric filler material comprises between 15.0 percent and 30.0 percent.

6. The insulation material of claim 1, wherein the polymeric filler material and the base polymeric material are not chemically compounded together.

7. A communications cable for use in a plenum, the cable comprising:

at least one transmission element; and a covering formed via extrusion around the at least one transmission element, the covering comprising:

a base polymeric material having a first melting point lower than a temperature at which the covering is extruded; and a polymeric filler material blended with the base polymeric material, the polymeric filler comprising between 0.5 percent to 50.0 percent by weight of the covering an the polymeric filer having a second melting point greater than the temperature at which the covering is extruded, wherein the polymeric filler comprises at least one of fluorinated ethylene propylene (FEP), polyvinylidene fluoride (PVDF), perfluoroalkoxy alkane (PFA), or polytetrafluoroethylene (PTFE).

8. The communications cable of claim 7, wherein the polymeric filler comprises fluorinated ethylene propylene (FEP).

9. The communications cable of claim 8, wherein the polymeric filler and the base polymeric material are not chemically compounded together.

10. The communications cable of claim 7, wherein the polymeric filler comprises at least one of polyvinylidene fluoride (PVDF), perfluoroalkoxy alkane (PFA), or polytetrafluoroethylene (PTFE).

11. The communications cable of claim 7, wherein the base polymeric material comprises at least one of polyvinyl chloride (PVC), polyethylene (PE), polypropylene (PP), chlorinated polyethylene (CPE), nylon, polyester, or polybutylene terephthalate (PBT).

12. The communications cable of claim 7, wherein the polymeric filer comprises between 15.0 percent and 30.0 percent by weight of the covering.

13. The communications cable of claim 7, wherein the covering comprises an outer jacket of the communications cable.

14. The communications cable of claim 7, wherein the covering comprises a tube formed around the at least one transmission element.

15. A communications cable for use in a plenum, the cable comprising:

at least one transmission element; and a covering formed via extrusion around the at least one transmission element, the covering comprising:

a base polymeric material having a first melting point lower than a temperature at which the covering is extruded; and a polymeric filler material blended with the base polymeric material, the polymeric filler comprising between 0.5 percent to 50.0 percent by weight of the covering an the polymeric filer having a second melting point greater than the temperature at which the covering is extruded, wherein the polymeric filler comprises fluorinated ethylene propylene.

16. The communications cable of claim 15, wherein the base polymeric material comprises at least one of polyvinyl chloride (PVC), polyethylene (PE), polypropylene (PP), chlorinated polyethylene (CPE), nylon, polyester, or polybutylene terephthalate (PBT).

17. The communications cable of claim 15, wherein the polymeric filer comprises between 15.0 percent and 50.0 percent by weight of the covering.

18. The communications cable of claim 15, wherein the polymeric filler and the base polymeric material are not chemically compounded together.

19. The communications cable of claim 15, wherein the covering comprises an outer jacket of the communications cable.

20. The communications cable of claim 15, wherein the covering comprises a tube formed around the at least one transmission element.

* * * * *